US005982085A

United States Patent [19]

Lakshmanan et al.

[11] Patent Number: 5,982,085

[45] Date of Patent: Nov. 9, 1999

[54] COLOR CATHODE RAY TUBE WITH IMPROVED SHADOW MASK MOUNTING SYSTEM

[75] Inventors: Venugopal Lakshmanan, Ann Arbor, Mich.; Con Brantjes, Eindhoven, Netherlands

[73] Assignee: Philips Electronics North America Corporation, New York, N.Y.

[21] Appl. No.: 08/996,676

[22] Filed: Dec. 23, 1997

[51] Int. Cl.[6] ..... H01J 29/80

[52] U.S. Cl. ..... 313/407; 313/402

[58] Field of Search ..... 313/402, 403, 313/404, 405, 406, 407, 408

[56] References Cited

U.S. PATENT DOCUMENTS

| | | | |
|---|---|---|---|
| 3,935,496 | 1/1976 | Gijrath | 313/402 |
| 3,986,071 | 10/1976 | Groot | 313/404 |
| 3,986,072 | 10/1976 | Adamski | 313/404 |
| 3,999,098 | 12/1976 | Dougherty | 313/407 |
| 4,300,071 | 11/1981 | Dougherty et al. | 313/407 |
| 4,358,702 | 11/1982 | Gijrath et al. | 313/404 |
| 4,387,321 | 6/1983 | Gijrath et al. | 313/406 |
| 4,639,636 | 1/1987 | Bakker et al. | 313/408 |
| 4,652,792 | 3/1987 | Tokita et al. | 313/404 |
| 4,670,687 | 6/1987 | Gijrath et al. | 313/404 |
| 5,003,218 | 3/1991 | Gijrath et al. | 313/406 |
| 5,072,151 | 12/1991 | Spina | 313/407 |
| 5,676,863 | 10/1997 | Kim et al. | 313/404 |

OTHER PUBLICATIONS

"An Improved Shadow–Mask System for Large Size CRTs" by Richard C. Bauder and F.R. Ragland, SID Int'l Technical Papers (1990) pp. 426–429, Jan. 1, 1990.

"Corner Lock Suspension" by Robert L. Donofrio, Nov. 1995, Information Display, pp. 12–19.

*Primary Examiner*—Vip Patel
*Assistant Examiner*—Matthew Gerike
*Attorney, Agent, or Firm*—John C. Fox

[57] ABSTRACT

An apertured shadow mask directs electron beams toward phosphor elements on the inside surface of the face plate of a CRT. The mask is fixed to a rectangular frame having corner brackets connected by light-weight diaphragm strips and resilient plates molded to the brackets. The resilient plates have holes toward the distal ends thereof which engage pins embedded in a skirt surrounding the face plate. The plates are precipitation hardened stainless steel having a thickness of 0.20 mm to 0.30 mm and provide sufficient spring force to retain the mask and frame as well as the internal magnetic shield which is fixed to the corner brackets by clips.

9 Claims, 5 Drawing Sheets

COLOR CATHODE RAY TUBE WITH IMPROVED SHADOW MASK MOUNTING SYSTEM

BACKGROUND OF THE INVENTION

This invention relates to a cathode ray tube (CRT) for color television and allied display applications, employing a shadow mask for color separation, and more particularly relates to such a CRT having an improved shadow mask mounting system.

CRTs for color television, computer monitors and other display applications rely on a cathodoluminescent phosphor screen to provide a visible display. Such a screen is composed of a repetitive pattern of a large number of small red, blue and green-emitting phosphor elements, which are excited to luminescence by electron beams emanating from an electron gun behind the screen. There are three beams, one for each of the red, blue and green components of a color display signal. In operation, the screen is repetitively scanned by the three beams simultaneously, while the intensities of the beams are modulated by the respective individual primary color components of the display signal. The large number of phosphor elements, together with the scanning frequency, results in the perception of a steady, full color display by a viewer.

Such CRTs typically employ a shadow mask to achieve color separation. A shadow mask is a thin sheet having a large number of apertures and mounted between the phosphor screen and the electron gun, a short distance behind the screen. The apertures are aligned with the phosphor elements on the screen and the electron beams are directed from the electron gun to converge at the mask. When the beams pass through the individual apertures, they diverge from one another to land on the phosphor element of the corresponding color.

The mask, which is typically 0.15 to 0.25 mm thick, is supported on a frame to maintain its shape. This frame is then securely mounted in the glass envelope in order to maintain the mask in proper registration with the screen. Such registration must not only be maintained in the X and Y directions, but also in the Z direction, i.e., along the tube axis in order to insure that the beams do not land on adjacent phosphor elements, which would degrade the color purity of the display image.

Particularly during the warm-up period, the mask heats up and expands in all directions. Once the frame also warms up, then the thermal compensation effect of the suspension system takes place, moving the whole mask closer to the screen, maintaining overall color purity by bringing all of the mask apertures back into the electron beam path. When the temperature differential between the mask and frame is large during initial warm-up, the time required for thermal compensation is longer. This differential is minimized by using a frame of as low a mass as possible.

A common technique to maintain the proper Q space (distance between mask and screen) during tube warm-up has been to employ bimetal mounting springs attached to three sides of the frame, which springs are attached to mounting studs embedded in the wall of the glass envelope.

As the mask heats and expands in the X, Y, and Z directions, the mounting springs also heat, and the different expansion rates of the component metals in the springs produce a compensating motion of the entire mask toward the screen.

A more recent design employs a so-called "corner lock" suspension system, in which corner lock mechanisms, each of which include thermal compensation means, are attached to the four corners of the frame. This results in a more stable arrangement than that achievable using the side mounting arrangement, thereby enabling use of a lighter and less costly mask and/or frame.

U.S. Pat. Nos. 3,986,072 and 3,999,098, assigned to Zenith Radio Corporation, disclose corner lock systems wherein the frame is formed integrally with the mask, which is welded to four corner brackets. Cantilevered leaf springs welded to the corner brackets engage legs fixed to the face plate of the vacuum tube adjacent four corners of the display screen. Three of the springs are provided with holes which engage studs on the legs, while a fourth spring is provided with a slot which engages a stud on the fourth leg. This slot permits movement of the mask in the X and Y directions (parallel to the screen) and fix it in the Z direction.

The "frameless mask" of Zenith is formed in a complex shape in order to provide the structural integrity to withstand compressive stresses for mounting without welding. However it is not sufficiently strong to support direct mounting of an internal magnetic shield to the corner brackets.

The current Philips mask suspension system is described in an article by Robert Donofrio entitled "Corner Lock Suspension" in the November 1995 issue of Information Display. This system employs corner brackets welded to lightweight diaphragm strips to form a rectangular frame; each diaphragm strip has an angular cross section formed by a base section and an upright section to which the shadow mask is welded. A resilient plate, also referred to as a temperature compensating plate or as a hinge plate, is fixed to each corner plate by a spring which loads it toward a pin embedded in a corner of the skirt adjacent to the face plate. The pin is engaged by a floating washer mounted to the hinge plate. During assembly, the floating washers are welded to the hinge plates after the mask/frame assembly is engaged to the pins. The phosphor elements are then applied in a photo-lithographic screening process which involves removing and replacing the assembly several times. After a conductive coating is applied to the phosphor elements, the assembly is fixed in place by welding the floating washers to the studs. The internal magnetic shield is fixed in the vacuum envelope independently by separate links which are welded to the studs over the frame assembly.

U.S. Pat. No. 4,652,792 of Toshiba discloses a rectangular frame which is suspended at its corners by spring members which provide geometric temperature compensation during warmup. The frame is 1.6 mm thick and therefore relatively heavy, and generates considerable scrap during manufacture insofar as it is stamped from a single piece and formed without seams.

A corner suspension system of Thompson Consumer Electronics is described in an article by R. C. Bauder and F. R. Ragland entitled "An Improved Shadow-Mask Support System for Large-Size CRTs" in SID Intl. Technical Papers (1990). This system employs bimetal clips welded to the corners of a one-piece frame, and backward extending springs welded to the distal ends of the clips.

Drawbacks of the known systems include difficulty in salvaging masks and frames, where they are welded to the studs; high scrap rates during manufacture; complex parts including bimetallic clips; inability to mount the IMS directly to the frame; or systems with heavy frames, which result in poor color purity from the long warm up times, and instability of the assembly when dropped.

SUMMARY OF THE INVENTION

According to the invention, the frame is a light weight frame with four diaphragm elements 0.2 to 0.4 mm thick welded to the corner brackets and resilient plates extending away from the display screen cantilever-fashion to engage the mounting pins embedded in the skirt. These plates provide the sole spring force for loading the plates against the pins, and this spring force provides the sole retention between the frame and the skirt. The internal magnetic shield is attached directly to the corner brackets of the frame.

Since the plates are not welded to the pins, the material of the plates as well as its thickness and shape must be chosen to provide a spring force exceeding two pounds in order to withstand the shock incurred by dropping the CRT as well as long term thermal cycling. In this regard a precipitation hardened stainless steel having a thickness of 0.20 mm to 0.30 mm and a trapezoidal shape has been found to be especially suitable.

The CRT according to the invention reduces the amount of scrap during manufacture, because the diaphragm strips are formed from strip stock, rather than stamping a rectangular shape and forming it.

If either the mask and frame or the face plate and skirt are found to be defective subsequent to assembly, the components can be readily dismantled for salvage, which also reduces scrap. Likewise, the internal magnetic shield can be readily detached from the frame.

Since separate springs are not required to achieve adequate retention force, the number of parts and therefore the number of manufacturing steps are reduced. Likewise, the elimination of welding steps for retaining the mask/frame and the magnetic shield simplifies manufacture. The chief advantage of eliminating welding, however, is improved salvageability of the components.

DETAILED DESCRIPTION OF THE PREFERRED EMBODIMENTS

Figure 1:
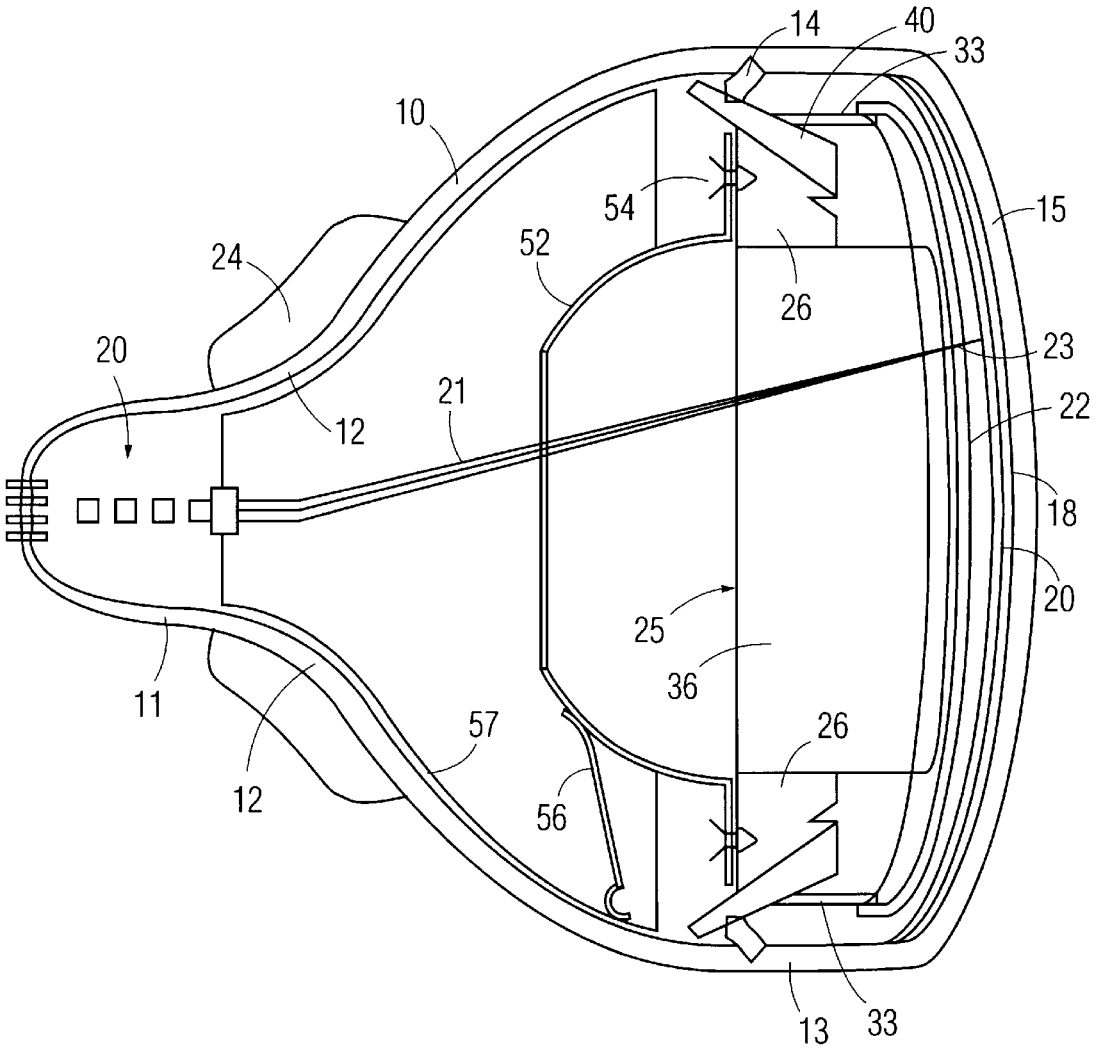
FIG. 1 is a section view of a cathode ray tube according to the invention.

Referring to FIG. 1, a color display tube includes a glass vacuum envelope 10 having a neck 11, a funnel 12, a substantially rectangular face plate 15, and a skirt 13 extending between the face plate and the funnel. Mounting pins 14 embedded in the skirt adjacent the four corners of the face plate serve to position the color selection electrode or shadow mask 22 with respect to the display screen 18 on the inside surface of the face plate 15. The display screen 18 is composed of a large number of red, green and blue luminescing phosphor elements which are covered with an aluminum coating 20. The elements luminesce when bombarded by electrons in the beams 21 emitted from an electron gun 20 mounted in the neck. The beams 21 are deflected by deflection coils 24 which are coaxially arranged about a longitudinal axis of the tube, and pass through apertures 23 in the mask 22 to illuminate the phosphor elements.

The mask 22 is welded to a supporting frame 25 which in turn is mounted on the pins 14. The frame 25 includes four corner brackets 26 connected by diaphragms 33 and 36, each bracket 26 having a resilient plate 40 welded thereto, the plates 40 being loaded against the pins 14 to position the mask 22 and frame 25 with respect to the vacuum envelope 10. According to the invention, an internal magnetic shield 52 is mounted directly to the corner brackets, in this example by dart clips 54. The shield 52 is connected to a metallic layer 57 on the inside of funnel 12 by spring loaded contact 56. This shields the electron beams from the earth's magnetic field and other interference.

Figure 2:
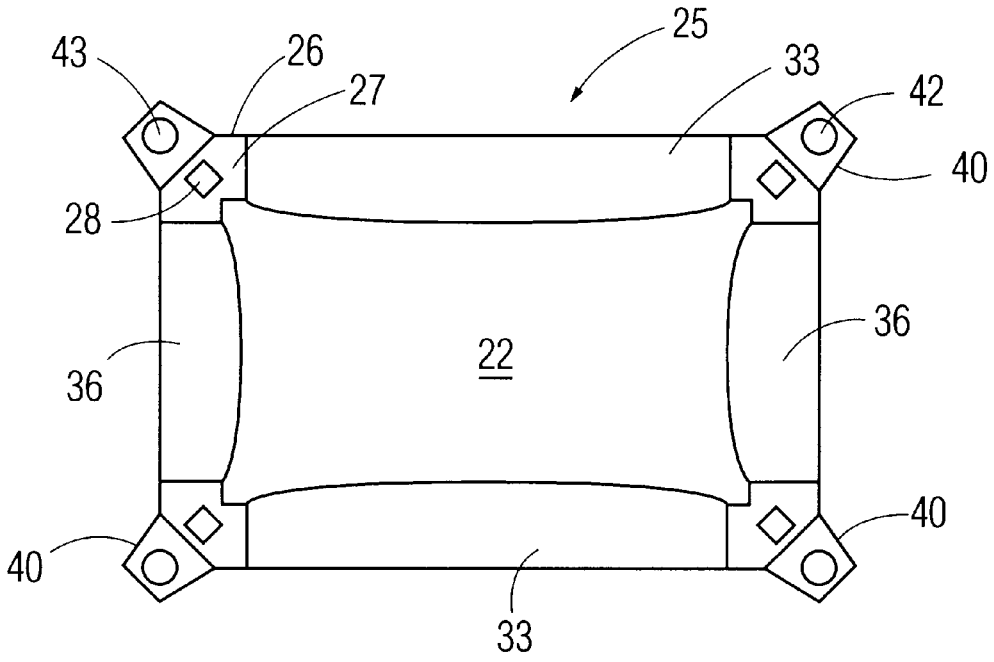
FIG. 2 is a plan view of the supporting frame and mask, seen from the rear.

FIG. 2 is a plan view of the mask 22 and frame 25 seen from the rear, i.e. the side opposite the display screen. Two long diaphragms 33 and two short diaphragms 36, all having angled cross sections, are welded to the corner brackets 26 to form a rectangle. Each of the diaphragms 33, 36 has a thickness of 0.2 mm to 0.4 mm, which closely matches the 0.2 mm thickness of the mask and assures a uniform expansion of the assembly during warm-up. The mask and diaphragms are preferably low carbon steel; the corner brackets, which are 0.5 to 0.8 mm thick, are either low carbon steel, nickel plated low carbon steel, or stainless steel. The corner brackets 26 each have a rectangular hole 28 which receives a dart clip for retaining the internal magnetic shield 52 (FIG. 1).

The resilient plates 40, which accommodate thermal expansion and are also referred to as temperature compensation plates, are welded to respective corner brackets 26 and extend toward the viewer as cantilevers. Three of the resilient plates 40 have round holes 42 which fix their corresponding corners in the Z direction, and also fix the entire mask diaphragm assembly in the X and Y directions. The fourth resilient plate has a slot 43 which fixes its corner in the Z direction, the position in the X and Y directions being fixed by the other three plates.

Figure 3:
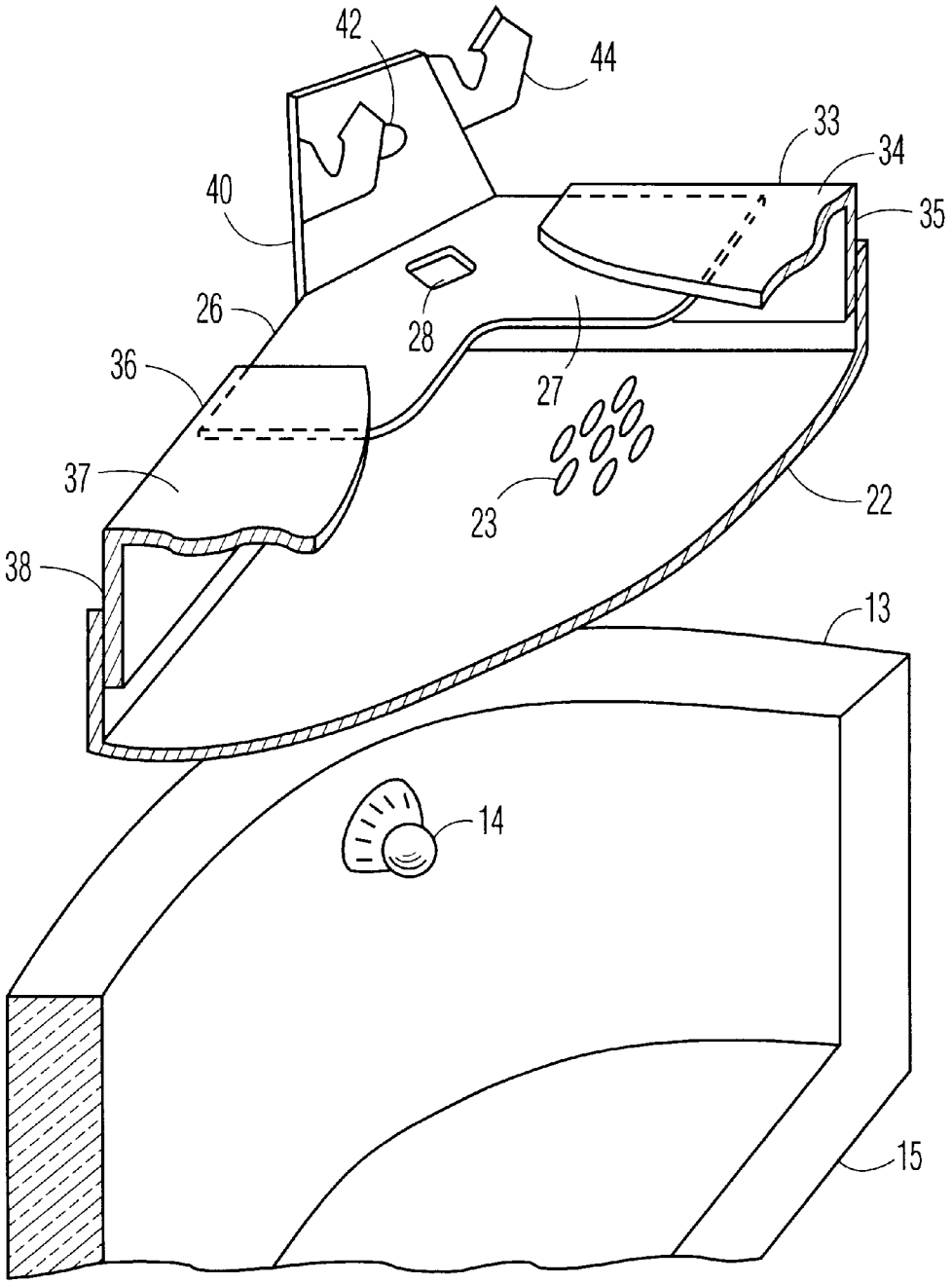
FIG. 3 is a partial perspective view of the corner bracket, frame, and mask exploded the face plate.
Figure 4:
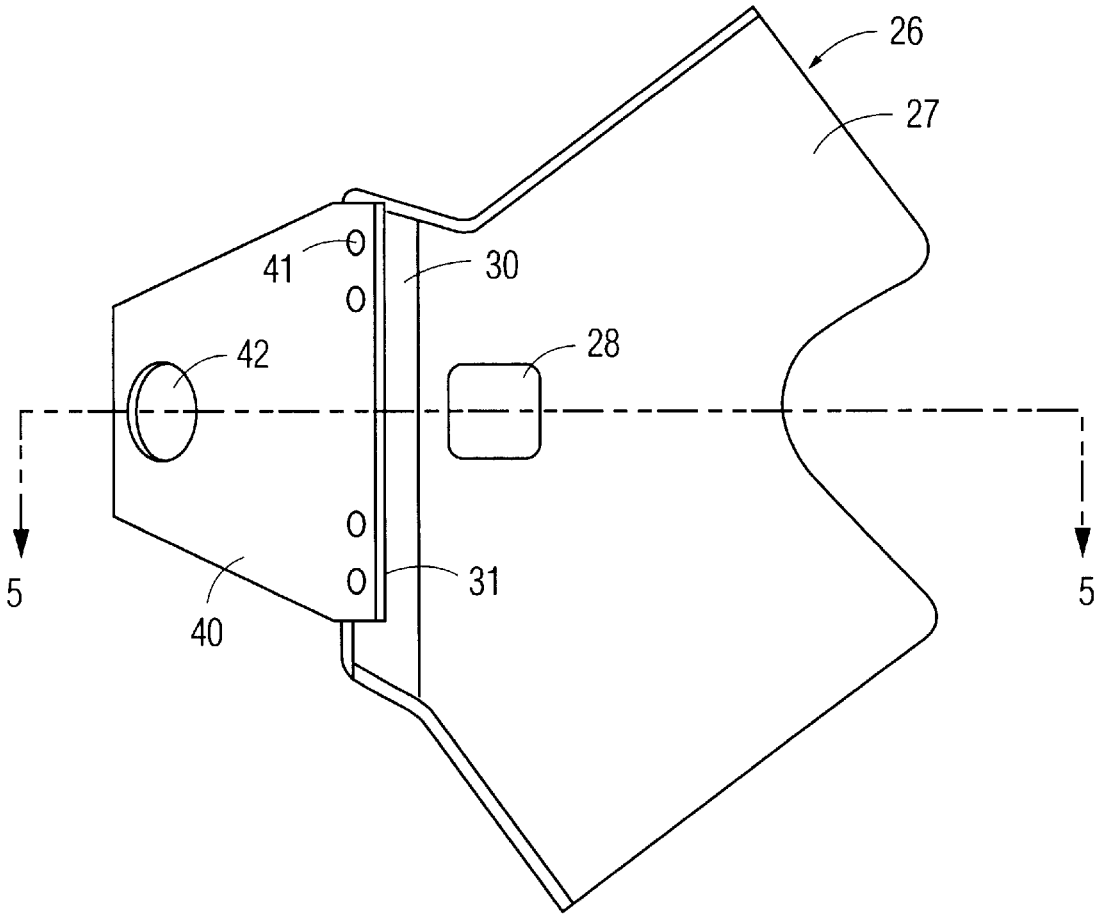
FIG. 4 is a plan view of a corner bracket and temperature compensating plate, seen from the front.
Figure 7:
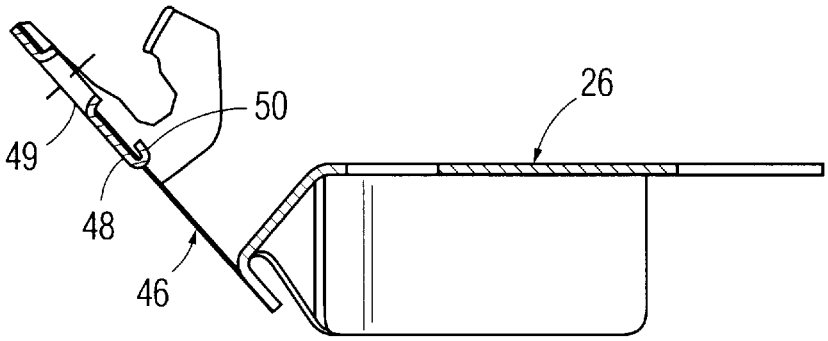
FIG. 7 is a section view taken along line 7—7 of FIG. 6.

FIG. 3 shows the assembly of mask and frame in greater detail. Each long diaphragm 33 is formed by a base portion 34 and an upright flange 35 which meet at a right angle. Each short diaphragm 36 is formed by a base portion 37 and an upright flange 38 which meet at a right angle. The base portions 34, 37 are welded to the base 27 of the corner bracket 26. The upright flanges 35, 38 serve as mounting means for the mask 22, which is welded thereto. Only some of apertures 23 for directing the electron beams are shown. The resilient plate 40 is welded to the bracket 26 as shown in FIG. 4, and is provided with a round aperture 42 which is aligned for mounting against the round head of pin 14 on the skirt 13. The handling ears 14 are designed for automated handling of the frame during manufacture and are not germane to the present invention.

During manufacture, the corner brackets 26 and plates 40 are placed on an assembly block which serves as a positioning jig (not shown), and the plates are welded to the respective corner brackets. The diaphragms are then welded to the corner brackets 26, and the completed frame is removed from the assembly block. The shadow mask 22 is then welded to the flanges 35, 38, and the assembly is placed in the skirt 13 with the plates 40 resiled so that the holes 42 and slot 43 engage respective pins 14. The assembly is now ready for screening.

Screening is a well known process in which a photosensitive coating for each of the colors is exposed through the mask and developed. First a coating for one color of luminescing phosphors is exposed, then the mask/frame is removed and the coating is developed to leave the luminescing elements. Then a photosensitive coating for another color is coated over the elements, the mask/frame is replaced, and the coating is exposed through the mask. The mask/frame is removed and the coating developed. The process is repeated for the third color, then all of the phosphor elements are coated with a 200–500 mm thick layer of aluminum and the mask/frame is again replaced on the pins 14. The internal magnetic shield 52 (FIG. 1) is then fixed to the frame by means of dart clips received through apertures 28, and the vacuum envelope 10 (FIG. 1) is sealed to the skirt and evacuated.

Figure 5:
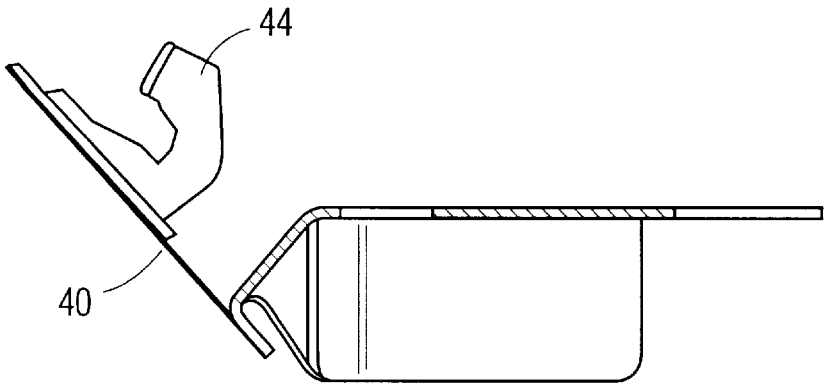
FIG. 5 is a section view taken along line 5—5 of FIG. 4.

FIG. 4 is a plan view of the corner bracket 26 and resilient plate 40 which is welded thereto; FIG. 5 is a section view. The two views will be discussed together.

Each bracket 26 comprises a flat base portion 27 from which lateral flanges 32 are formed at substantially right angles, and mounting flange 31 is formed at about forty-five degrees. The flange 31 is provided with a mounting tab 32 to which the plate 40 is welded at welds 41. The plate 40 extends rearward as a cantilever and provides the spring force for loading the holes 42 (and slot 43, FIG. 2) against the pins.

Figure 6:
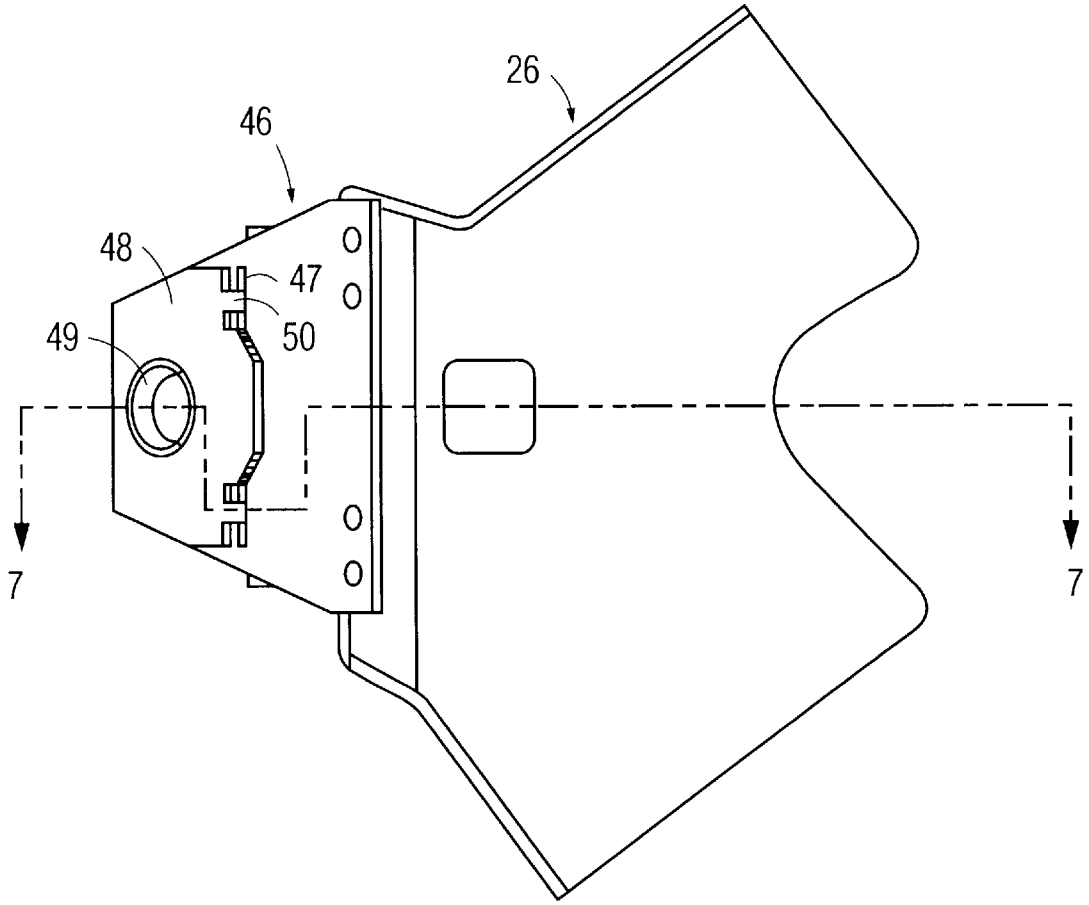
FIG. 6 is a plan view of a corner bracket and alternative embodiment of temperature compensating plate.

FIG. 6 is a plan view of an alternative embodiment of resilient plate 46 which carries a slide plate 48 having a formed boss 49 which engages the respective pin. The slide plate 48 can move in the X-Y plane by virtue of tabs 50 received through slots 47 in the TC plate. During manufacture, the slide plates 48 are welded to the plate 46, after the diaphragms are welded to the brackets, when the frame is initially placed on pins. This assures precise alignment with the face plate, but entails additional parts.

Essential to the present invention are the choice of material, thickness, and shape of the resilient plates 40. These design considerations should be effective to load each plate against the respective pin with a force of at least two pounds, without being subject to fatigue over the life of the CRT. This is necessary to maintain alignment of the mask and frame with an internal magnetic shield fixed thereto, without welding the assembly to the skirt on the face plate.

The material of the resilient plates is preferably a precipitation hardened stainless steel such as Cartech Custom 450, Custom 455, 466, 17-7PH, etc. These steels consist mainly of Fe, Ni, Cr, and other additives as necessary to provide a yield strength between 50 and 300 ksi, preferably exceeding 200 ksi. The thickness is preferably 0.20 to 0.40 mm, and the shape is tapered to form a trapezoid substantially as shown. In the preferred embodiment a 17-7PH steel is used, and the trapezoid has parallel edges with lengths of 9 mm and 28 mm, and connecting edges with lengths of 24 mm.

For the alternative embodiment of TC plate 46 shown in FIGS. 5 and 6, the slide plate 48 is of like material as the plate 46, which is as for plate 40. In an alternative embodiment of the slide plate 48, it may be of regular stainless steel such as 304 or 305 which are composed of 18% Cr and 8% and 12% N; respectively, the remainder being substantially Fe.

The foregoing is exemplary and not intended to limit the scope of the claims which follow.

What is claimed is:

1. A cathode ray tube comprising:

a vacuum envelope having a neck, a funnel, a substantially rectangular face plate with an inside surface, a skirt extending between said face plate and said funnel, and four pins extending inward from said skirt adjacent respective corners of said face plate, a display screen on said inside surface, said display screen comprising a plurality of phosphor elements and an electrically conductive coating, an electron gun assembly arranged in said neck for emitting electrons toward said display screen, a substantially rectangular shadow mask mounted adjacent to said display screen and comprising a plurality of apertures which direct electrons toward the phosphor elements, and a substantially rectangular supporting frame to which said shadow mask is connected, said frame comprising four corner brackets connected by two long diaphragm elements and two short diaphragm elements having a thickness of 0.2 mm to 0.4 mm, and four resilient plates fixed directly to respective corner brackets, each plate having aperture means engaging a respective one of said pins and being spring loaded thereagainst, said plates providing the sole spring force for loading the plates against the pins, said spring force providing the sole retention between said frame and said skirt.

2. A cathode ray tube as in claim 1 further comprising an internal magnetic shield attached directly to said corner brackets.

3. A cathode ray tube as in claim 1 wherein said resilient plates are made of precipitation hardened stainless steel.

4. A cathode ray tube as in claim 3 wherein said steel has a yield strength exceeding 200 ksi.

5. A cathode ray tube as in claim 2 wherein said resilient plates have a thickness of 0.2 mm to 0.3 mm.

6. A cathode ray tube as in claim 1 wherein each resilient plate is loaded against said respective one of said pins with a spring force exceeding two pounds.

7. A cathode ray tube as in claim 1 wherein three of said resilient plates have aperture means consisting of a round hole, and a fourth one of said resilient plates has aperture means consisting of an elongate slot having a major axis which is coplanar with said round holes.

8. A cathode ray tube as in claim 2 further comprising four dart clips, each said corner bracket having a hole receiving one of said dart clips to attach said internal magnetic shield to said supporting frame.

9. A cathode ray tube as in claim 1 wherein each of said diaphragm elements has an angled cross section with a right angle bend extending between corner brackets.

* * * * *